US011096488B2

(12) United States Patent
Zhan

(10) Patent No.: US 11,096,488 B2
(45) Date of Patent: Aug. 24, 2021

(54) THREE-SECTION LINKAGE DRAWER SLIDES APPARATUS

(71) Applicant: Foshan Aodeli Metal Products Co., Ltd., Guangdong (CN)

(72) Inventor: Yuliang Zhan, Guangdong (CN)

(73) Assignee: Foshan Aodeli Metal Products Co., Ltd., Foshan (CN)

( * ) Notice: Subject to any disclaimer, the term of this patent is extended or adjusted under 35 U.S.C. 154(b) by 0 days.

(21) Appl. No.: 16/893,395

(22) Filed: Jun. 4, 2020

(65) Prior Publication Data

US 2021/0022498 A1 Jan. 28, 2021

(30) Foreign Application Priority Data

Jul. 25, 2019 (CN) ..... 201910679055.2

(51) Int. Cl.
*A47B 88/493* (2017.01)
*A47B 88/437* (2017.01)
*A47B 88/447* (2017.01)

(52) U.S. Cl.
CPC ..... *A47B 88/493* (2017.01); *A47B 88/437* (2017.01); *A47B 88/447* (2017.01); *A47B 2210/004* (2013.01); *A47B 2210/007* (2013.01); *A47B 2210/0008* (2013.01); *A47B 2210/0013* (2013.01); *A47B 2210/0035* (2013.01);

(Continued)

(58) Field of Classification Search
CPC ... A47B 88/0466; A47B 88/437; A47B 88/44; A47B 88/447; A47B 88/49; A47B 88/493; A47B 2210/0008; A47B 2210/001; A47B 2210/0013; A47B 2210/0035; A47B 2210/004; A47B 2210/0043; A47B 2210/0048; A47B 2210/0056; A47B 2210/0064; A47B 2210/0067; A47B 2210/007; A47B 2210/0072; A47B 2210/0075
See application file for complete search history.

(56) References Cited

U.S. PATENT DOCUMENTS 6,854,817 B1 * 2/2005 Simon ..... A47B 88/493 312/334.6
8,277,003 B2 * 10/2012 Milligan ..... A47B 88/493 312/334.6

(Continued)

FOREIGN PATENT DOCUMENTS

CN 208863837 U 5/2019
WO WO-2009036882 A2 * 3/2009 ..... A47B 88/493
WO WO-2015052047 A1 * 4/2015 ..... F16C 29/048

*Primary Examiner* — Andrew M Roersma

(57) ABSTRACT

A three-section linkage drawer slides apparatus, includes an upper rail, a middle rail, a fixed rail, an upper linkage rack, and a lower linkage rack, wherein the middle rail is slidably connected to the fixed rail through the lower linkage rack, the upper rail is slidably connected to the middle rail through the upper linkage rack, the upper linkage rack and the lower linkage rack are of separate structures, the upper linkage rack is mounted between the middle rail and the upper rail after being assembled, and the lower linkage rack is mounted between the fixed rail and the middle rail after being assembled. The upper linkage rack and the lower linkage rack are configured as separate structures, the manufacturing process can thus be simplified, so the manufacturing cost is reduced.

6 Claims, 12 Drawing Sheets

(52) U.S. Cl.
CPC ..... *A47B 2210/0048* (2013.01); *A47B 2210/0075* (2013.01)

(56) References Cited

U.S. PATENT DOCUMENTS

| | | | | |
|---|---|---|---|---|
| 8,430,567 | B2 * | 4/2013 | Lobbezoo | F16C 29/045 384/19 |
| 8,833,880 | B2 * | 9/2014 | Chung | A47B 88/437 312/334.11 |
| 9,784,314 | B2 * | 10/2017 | Ng | F16C 29/04 |
| 9,788,655 | B2 * | 10/2017 | Chen | A47B 88/463 |
| 9,993,077 | B2 * | 6/2018 | Chen | F16C 29/005 |
| 10,506,879 | B1 * | 12/2019 | Chen | A47B 88/493 |
| 2016/0128473 | A1 * | 5/2016 | Ng | A47B 88/49 74/422 |
| 2020/0187649 | A1 * | 6/2020 | Meusburger | F16C 29/048 |

* cited by examiner

THREE-SECTION LINKAGE DRAWER SLIDES APPARATUS

CROSS REFERENCE TO RELATED APPLICATIONS

The present application claims the benefit of Chinese Patent Application No. 201910679055.2 filed on Jul. 25, 2019, the contents of which are incorporated herein by reference in their entirety.

TECHNICAL FIELD

The invention relates to the technical field of drawers, in particular to a three-section linkage drawer slides apparatus.

BACKGROUND ART

Drawer slides are a hardware accessory used on a furniture cabinet body, the prior art drawer slides generally include two-section and three-section linkage types, and compared with the two-section type, the three-section linkage drawer slides are more flexible and have lower resistance during sliding. A prior art three-section linkage drawer slide generally includes an upper rail, a middle rail, a fixed rail, and other components, wherein the fixed rail is connected with a cabinet body of a drawer and is fixed on the cabinet body by screws. The upper rail is connected with a handle locked on the drawer. When the drawer is pushed and pulled, the drawer is opened and closed through the operation of the drawer slides. Many complex parts cause high difficulties in assembling, with the production difficulties and costs increased while the production efficiency lowered.

In the patent application No. 201821064824.5, a three-section linkage drawer slides assembly is disclosed, including a movable rail, a middle rail and a fixed rail, wherein the movable rail is provided with a horizontal first upper plate portion, two ends of the first upper plate portion are vertically bent downwards to form a first left vertical portion and a first right vertical portion, and the first left vertical portion and the first right vertical portion extend inwards to form bent portions; the middle rail is provided with a second upper plate portion parallel to the first upper plate portion, one end of the second upper plate portion is connected with a second right vertical portion through an outward convex arc transition and an inward concave arc groove, the second right vertical portion is vertically bent inwards to form a second lower plate portion, the other end of the second upper plate portion is connected with a second left vertical portion through an outward convex arc transition and an inward concave arc groove, and a lower end of the second left vertical portion is curved inwards; an upper holder is provide between the movable rail and the middle rail, and a lower holder is provided between the middle rail and the fixed rail.

However, the three-section linkage drawer slides assembly above requires high precision in mounting, bringing difficulties in assembling, with the production difficulties and costs increased while the production efficiency lowered.

SUMMARY OF THE INVENTION

It is a primary object of the invention to solve the above problem by providing a three-section linkage drawer slides apparatus, which is simple to assemble and can reduce the manufacturing costs.

It is another object of the invention to provide a three-section linkage drawer slides apparatus, which is facilitated to assemble and disassemble, good in sliding performance, and capable of greatly improving production efficiency.

In order to achieve the above objects, the technical solution of the invention is as follows.

The invention provides a three-section linkage drawer slides apparatus, comprising an upper rail, a middle rail, a fixed rail, an upper linkage rack, and a lower linkage rack, the middle rail is slidably connected to the fixed rail through the lower linkage rack, the upper rail is slidably connected to the middle rail through the upper linkage rack, the upper linkage rack and the lower linkage rack are of separate structures, the upper linkage rack is mounted between the middle rail and the upper rail after being assembled, and the lower linkage rack is mounted between the fixed rail and the middle rail after being assembled. According to the invention, wherein the upper linkage rack and the lower linkage rack are configured as separate structures, the manufacturing process can thus be simplified, so the manufacturing cost is reduced; the separate structures can be quickly assembled into an integrated structure and shared in drawer slides with different lengths, which reduces the production and assembly difficulty, facilitates assembling and disassembling the drawer slide device, renders good sliding performance, and greatly improves production efficiency.

Further, the upper linkage rack comprises a first upper wheel frame, a second upper wheel frame and an upper linkage rack body, the first upper wheel frame and the second upper wheel frame are respectively detachably connected to the front and the rear ends of the upper linkage rack body, the first upper wheel frame and the second upper wheel frame are respectively provided with an upper wheel at upper portions thereof, the first upper wheel frame and the second upper wheel frame are respectively provided with a ball wheel on left and right side portions thereof, and the upper wheel and the ball wheel are positioned between the upper rail and the middle rail. According to the invention, the upper linkage rack comprises the first upper wheel frame, the second upper wheel frame, and the upper linkage rack body, the manufacturing process can be simplified through the configuration of the separate structure of the upper linkage rack, so the manufacturing cost is reduced; the separate structures can be quickly assembled into an integrated structure and the first upper wheel frame and the second upper wheel frame can be shared in drawer slides with different lengths, which reduces the production and assembly difficulty, facilitates assembling and disassembling the drawer slide device, renders good sliding performance, and greatly improves production efficiency; the upper wheel and the ball wheel are arranged between the upper rail and the middle rail and can support, roll and orient the middle rail and the upper rail during operation of the drawer slides.

Further, the front and rear ends of the upper linkage rack body are provided, respectively, with a clamping groove and a limiting block provided at an opening of the clamping groove, the first upper wheel frame and the second upper wheel frame, at ends facing the upper linkage rack body, are respectively provided with a limiting protrusion matched with the clamping groove, and when the first upper wheel frame and the second upper wheel frame are respectively connected to the front and rear ends of the upper linkage rack body, the limiting protrusions of the first upper wheel frame and the second upper wheel frame slide into the clamping grooves through the limiting blocks at the two ends of the upper linkage rack body respectively to be fixed. According to the invention, the arrangement of the clamping grooves, the limiting blocks and the limiting protrusions can facilitate mounting the first upper wheel frame, the second upper wheel frame and the upper linkage rack body, the first upper wheel frame and the second upper wheel frame can thus be quickly assembled with the upper linkage rack body into an integrated structure, and the first upper wheel frame and the second upper wheel frame can be shared in drawer slides with different lengths, which reduces the production and assembly difficulty, facilitates assembling and disassembling the drawer slide device, renders good sliding performance, and greatly improves production efficiency.

Further, the lower linkage rack comprises a first lower wheel frame, a second lower wheel frame and a lower linkage rack body, the first lower wheel frame and the second lower wheel frame are respectively detachably connected with two ends of the left side portion of the lower linkage rack body, and a large wheel is provided on the side portions, facing the lower linkage rack body, of the first lower wheel frame and the second lower wheel frame; a middle wheel is provided at both an upper portion and a bottom portion of the first lower wheel frame and the second lower wheel frame, respectively; a small wheel is provided at two ends, opposite the first lower wheel frame and the second lower wheel frame, of the right side portion of the lower linkage rack body, respectively; and the large wheel, the middle wheel and the small wheel are arranged between the fixed rail and the middle rail. According to the invention, the upper and lower linkage racks comprise the first lower wheel frame, the second lower wheel frame and the lower linkage rack body, the manufacturing process can be simplified through the configuration of the separate structure of the lower linkage rack, so the manufacturing cost is reduced; the separate structures can be quickly assembled into an integrated structure and the lower upper wheel frame and the second lower wheel frame can be shared in drawer slides with different lengths, which reduces the production and assembly difficulty, facilitates assembling and disassembling the drawer slide device, renders good sliding performance, and greatly improves production efficiency; the large wheel, the middle wheel and the small wheel are positioned between the fixed rail and the middle rail and can support, roll and orient the middle rail and the fixed rail during operation of the drawer slides.

Further, both ends of the left side portion of the lower linkage rack body are provided with fixing protrusions, the side portions, facing the upper linkage rack body, of the first lower wheel frame and the second lower wheel frame are provided with fixing grooves matched with the fixing protrusions, and when the first lower wheel frame and the second lower wheel frame are respectively connected to both ends of the left side portion of the lower linkage rack body, the fixing protrusions at the two ends of the left side portion of the lower linkage rack body are respectively clamped into the fixing grooves to render fixation. According to the invention, the arrangement of the fixing protrusions and the fixing grooves can facilitate mounting the first lower wheel frame, the second lower wheel frame and the lower linkage rack body, so the first lower wheel frame and the second lower wheel frame can be quickly assembled with the lower linkage rack body into an integrated structure, the first lower wheel frame and the second lower wheel frame can be shared in drawer slides with different lengths, which reduces the production and assembly difficulty, facilitates assembling and disassembling the drawer slide device, renders good sliding performance, and greatly improves production efficiency.

Furthermore, the middle rail is also provided with a gear assembly, the gear assembly comprises a mounting seat and a gear, the middle rail is provided with a fixing hole, the mounting seat is fixed in the fixing hole, the gear is disposed on the mounting seat, and the upper end and the lower end of the gear are respectively connected with the upper linkage rack and the lower linkage rack after reaching out, a rack adapted to the gear is provided on the upper linkage rack and the lower linkage rack, respectively; and when the upper rail slides on the middle rail, the gear transmits between the rack of the upper linkage rack and the rack of the lower linkage rack. According to the invention, According to the invention, the above arrangement can enable the gear to be quickly clamped into the middle rail after the gear is mounted on the mounting seat; after the drawer slide device is assembled, the gear, the upper linkage rack and the lower linkage rack can interact and are connected together to realize mutual transmission, and when the drawer slide device performs a push-pull action, the upper linkage rack and the lower linkage rack can move relative to each other driven by the gear, thereby realizing the three-section linkage movement function of the drawer slide device.

Further, the first upper wheel frame, the second upper wheel frame and the upper linkage rack body are provided with racks respectively along a length direction thereof, the racks of the first upper wheel frame, the second upper wheel frame and the upper linkage rack body are in opposite positions along a straight line when connected, and are positioned on a side of the connection of the limiting protrusion and the clamping groove; and the rack of the lower linkage rack is disposed on the lower linkage rack body along a length direction thereof. According to the invention, the above arrangement can enable the first upper wheel frame and the second upper wheel frame to be assembled with linkage rack bodies with different lengths, the transmission of the gear between the rack of the upper linkage rack and the rack of the lower linkage rack is not influenced after being assembled, which reduces difficulties in production and assembling, facilitates assembling and disassembling, and greatly improves the production efficiency.

Further, the mounting seat comprises a base, the base is provided with a slot for mounting a gear, a limiting shaft is provided on an inner wall of the slot, a shaft hole matched with the limiting shaft is provided at a central position of the gear, and when the gear is mounted in the slot, the limiting shaft extends into the shaft hole, so that the gear can rotate in the slot and thus transmission is realized between the rack of the upper linkage rack and the rack of the lower linkage rack. According to the invention, the above arrangement can enable the gear assembly to perform transmission better between the rack of the upper linkage rack and the rack of the lower linkage rack, so that the upper linkage rack and the lower linkage rack can move relative to each other driven by the gear, thereby realizing the three-section linkage movement function of the drawer slide device.

Further, the two ends of the base are integrally connected with elastic structures, respectively, the elastic structure is of a U-shape and is provided with limiting steps at an end, the fixing hole in the middle shaft comprises a middle hole matched with the base and square holes matched with the limiting steps of the elastic structure at the two ends of the base, and the base is inserted into the middle hole when the mounting seat is mounted on the middle shaft, moreover, the limiting steps of elastic structures at two ends of the base are clamped into the square holes to realize fixation. According to the invention, the arrangement of the middle hole and the square hole enables the base to be mounted in the middle hole of the middle rail, effectively fixing the horizontal front-rear and left-right positions of the gear; moreover, the limiting steps of the elastic structures at the two ends of the base are mounted in the square holes of the middle rail, effectively fixing the vertical direction of the gear by the arrangement of the limiting steps, so that the positions of the gear assembly and the middle rail are fixed; the above design is structurally reasonable, the gear and the base can be quickly clamped into the middle rail after being mounted, which is facilitated.

Further, the middle rail and the upper rail each comprises an upper plate portion and two side bent portions, the upper plate portion and the two side bent portions of the middle rail and the upper rail are connected through a reinforcing rib structure, the reinforcing rib structure comprises a first bending point, a second bending point and an inclined plane, two ends of the inclined plane are integrally connected with the first bending point and the second bending point, respectively, and the first bending point and the second bending point are arc-shaped structures. According to the invention, the arrangement of the first bending point, the second bending point and the inclined plane enable the connections of the upper plate portion with the two side bent portions of the middle rail or the upper rail are bent twice, so that the reinforcing rib structure is formed, thereby enhancing the bearing capacity and the stability, improving the stress condition of the middle rail and the upper rail, and stabilizing the structure.

Compared with the prior art, the upper linkage rack and the lower linkage rack are configured as separate structures, the manufacturing process can thus be simplified, so the manufacturing cost is reduced; the separate structures can be quickly assembled into an integrated structure and shared in drawer slides with different lengths, which reduces the production and assembly difficulty, facilitates assembling and disassembling the drawer slide device, renders good sliding performance, and greatly improves production efficiency.

DETAILED DESCRIPTION OF THE INVENTION

In order that the objects, aspects, and advantages of the invention will become more apparent, a detailed description of the invention will be rendered by referencing the appended drawings and embodiments. It is to be understood that the specific embodiments described herein are merely illustrative of the invention and are not intended to be limiting thereof.

In order to achieve the above objects, the technical solution of the invention is as follows.

Figure 1:
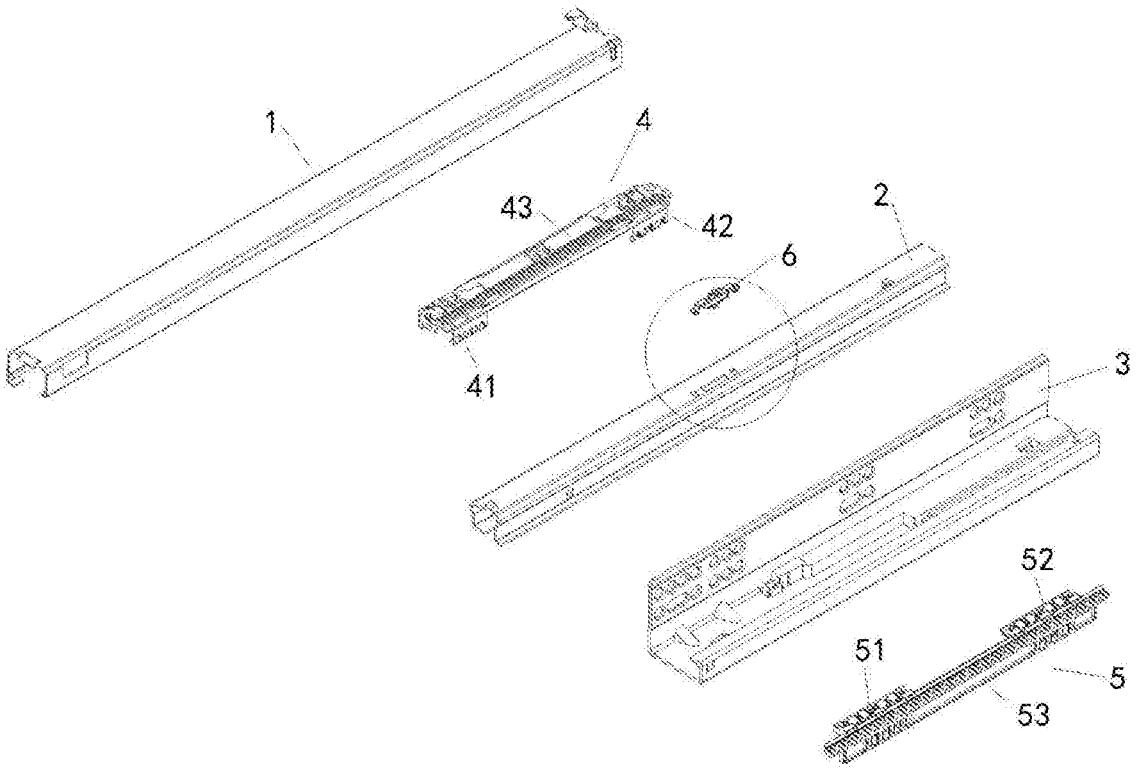
FIG. 1 is an exploded schematic view of a three-section linkage drawer slides apparatus according to an embodiment of the invention.
Figure 2:
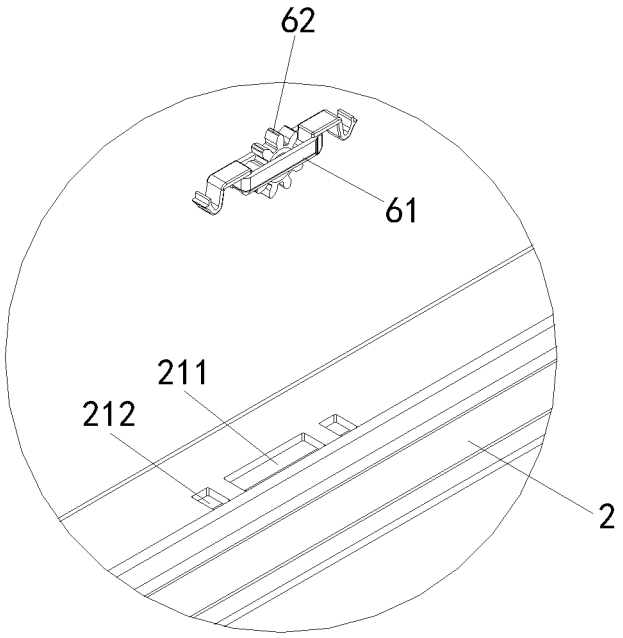
FIG. 2 is a partially enlarged diagram of an exploded schematic view of the three-section linkage drawer slides apparatus according to an embodiment of the invention.
Figure 3:
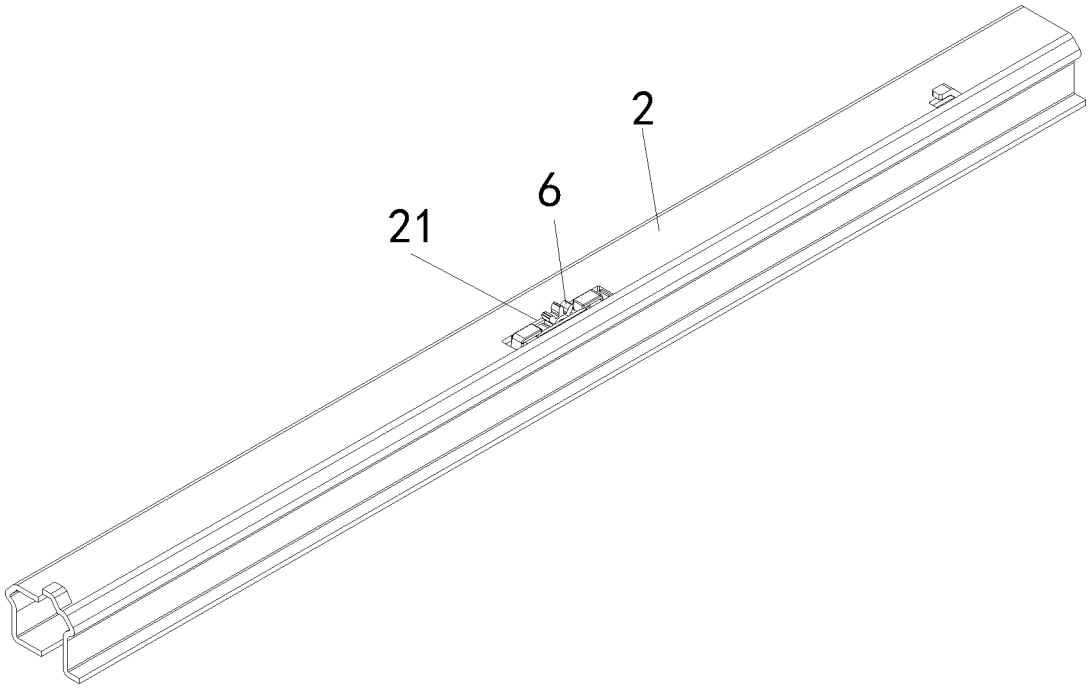
FIG. 3 is a schematic view showing a structure where a gear assembly of the three-section linkage drawer slides apparatus is provided on a middle rail according to an embodiment of the invention.
Figure 4:
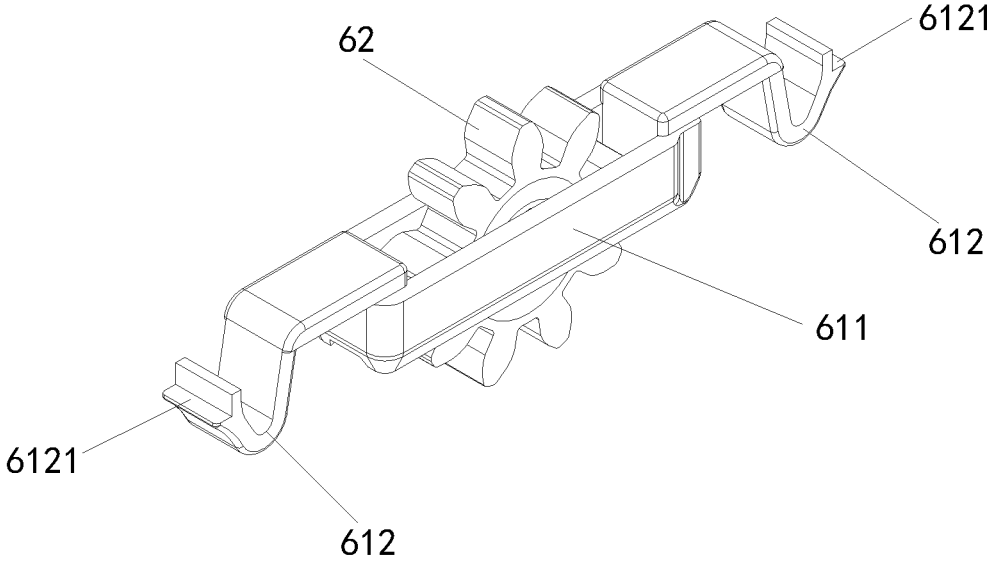
FIG. 4 is a schematic view showing the structure of the gear assembly of the three-section linkage drawer slides apparatus according to an embodiment of the invention.
Figure 5:
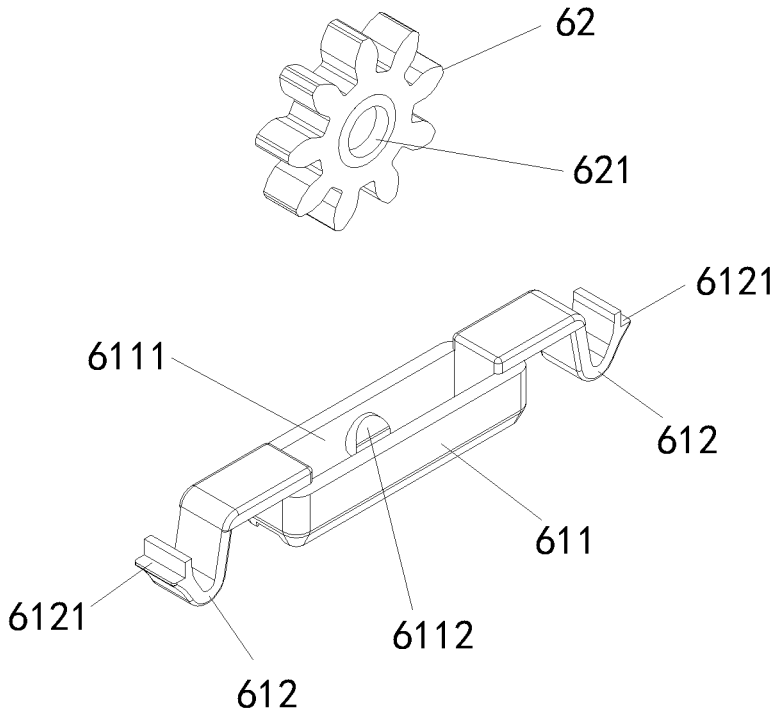
FIG. 5 is an exploded view of the gear assembly of the three-section linkage drawer slides apparatus according to an embodiment of the invention.
Figure 6:
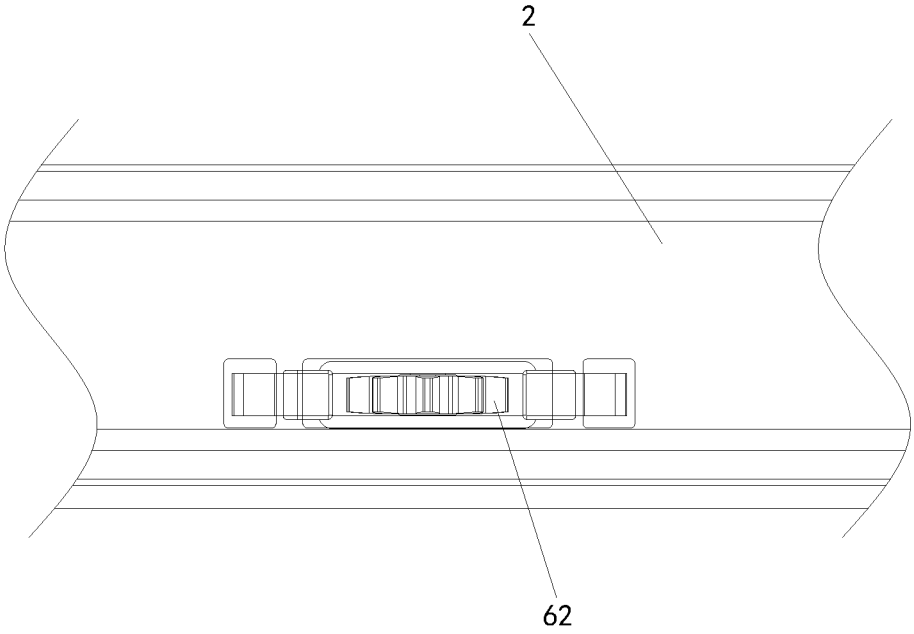
FIG. 6 is a partial top view of the gear assembly of the three-section linkage drawer slides apparatus when provided on the middle rail according to an embodiment of the invention.
Figure 7:
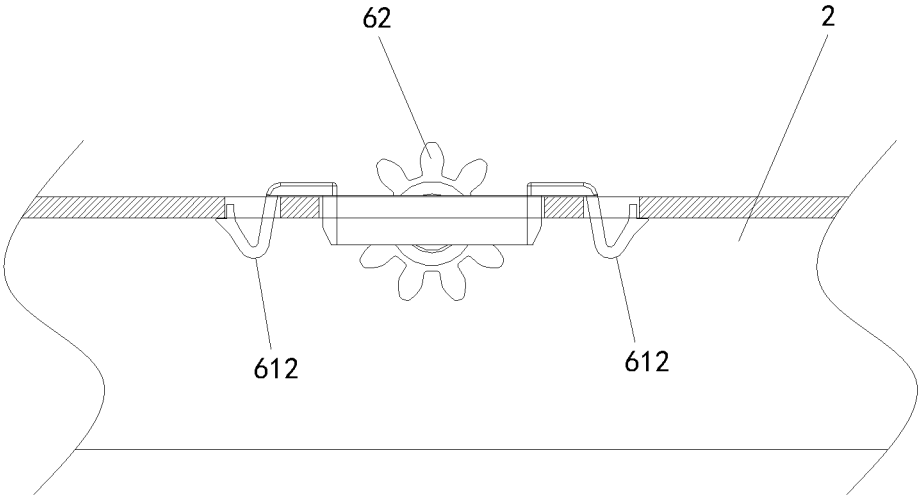
FIG. 7 is a partial cross-sectional view of the gear assembly of the three-section linkage drawer slides apparatus when provided on the middle rail according to an embodiment of the invention.
Figure 8:
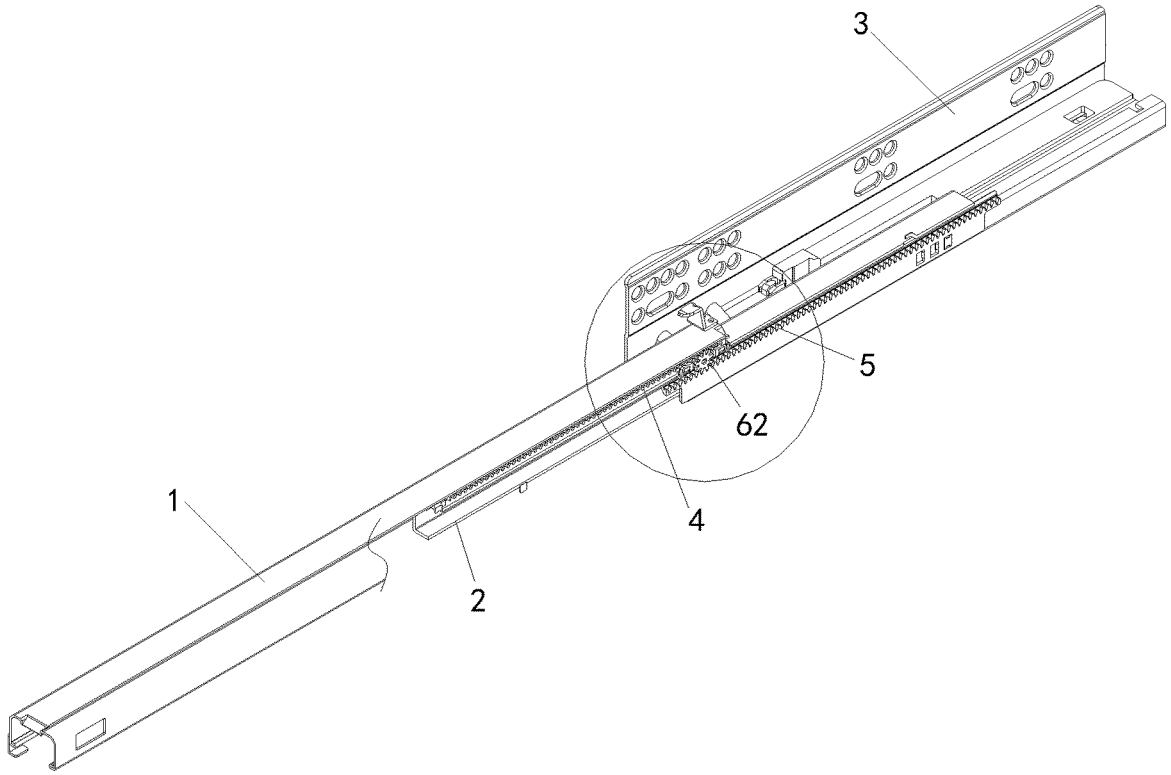
FIG. 8 is a schematic view showing a structure where the gear of the three-section linkage drawer slides apparatus is between an upper linkage rack and a lower linkage rack according to an embodiment of the invention.
Figure 9:
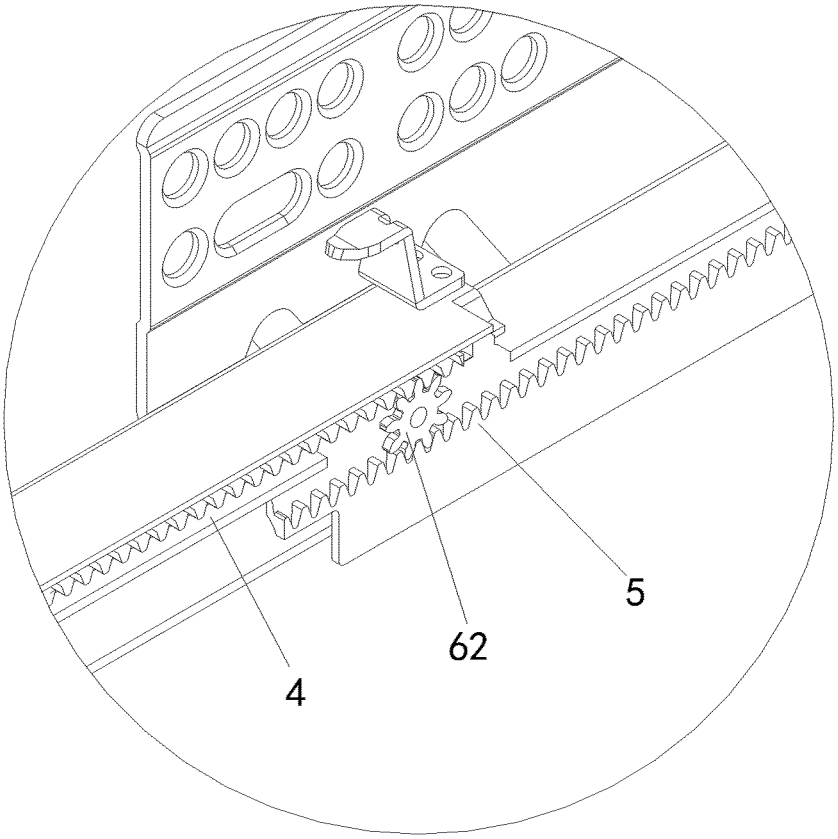
FIG. 9 is a partially enlarged diagram of a schematic view showing a structure where the gear of the three-section linkage drawer slides apparatus is between the upper link rack and the lower link rack according to an embodiment of the invention.
Figure 10:
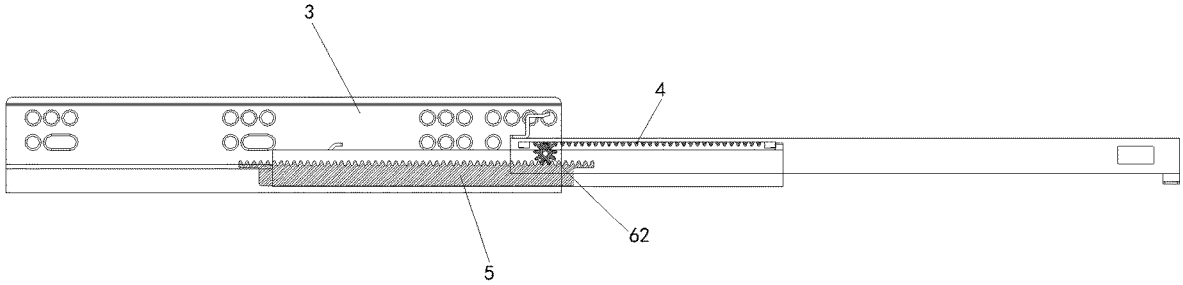
FIG. 10 is a sectional view of the gear of the three-section linkage drawer slides apparatus is between the upper linkage rack and the lower linkage rack according to an embodiment of the invention.
Figure 11:
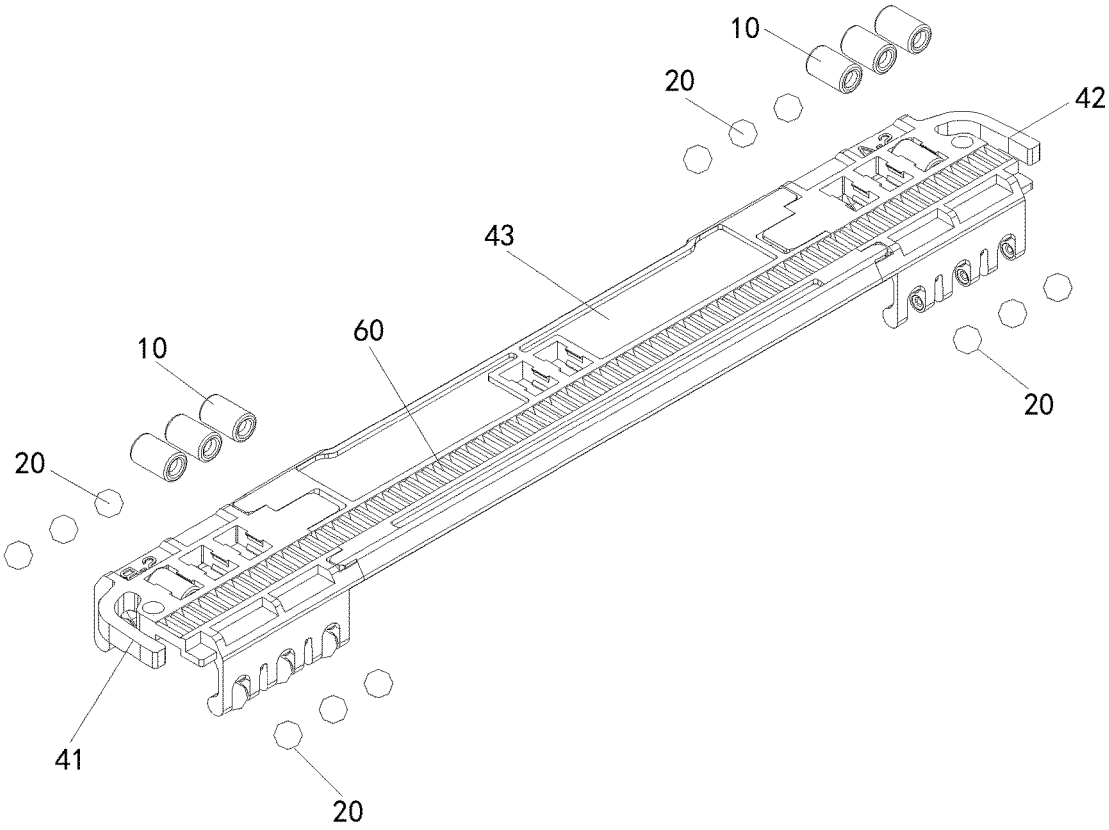
FIG. 11 is a schematic view showing a first explosion mode of the upper linkage rack of the three-section linkage drawer slides apparatus according to an embodiment of the invention.
Figure 12:
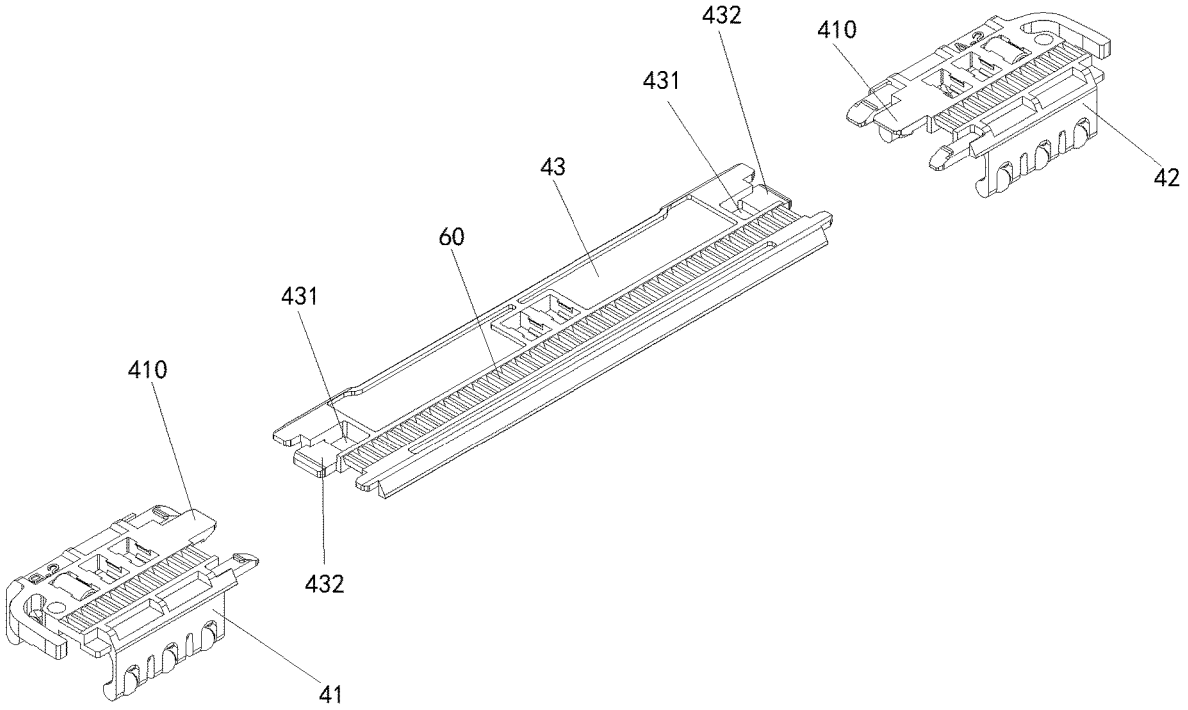
FIG. 12 is a schematic view showing a second explosion mode of the upper linkage rack of the three-section linkage drawer slides apparatus according to an embodiment of the invention.
Figure 13:
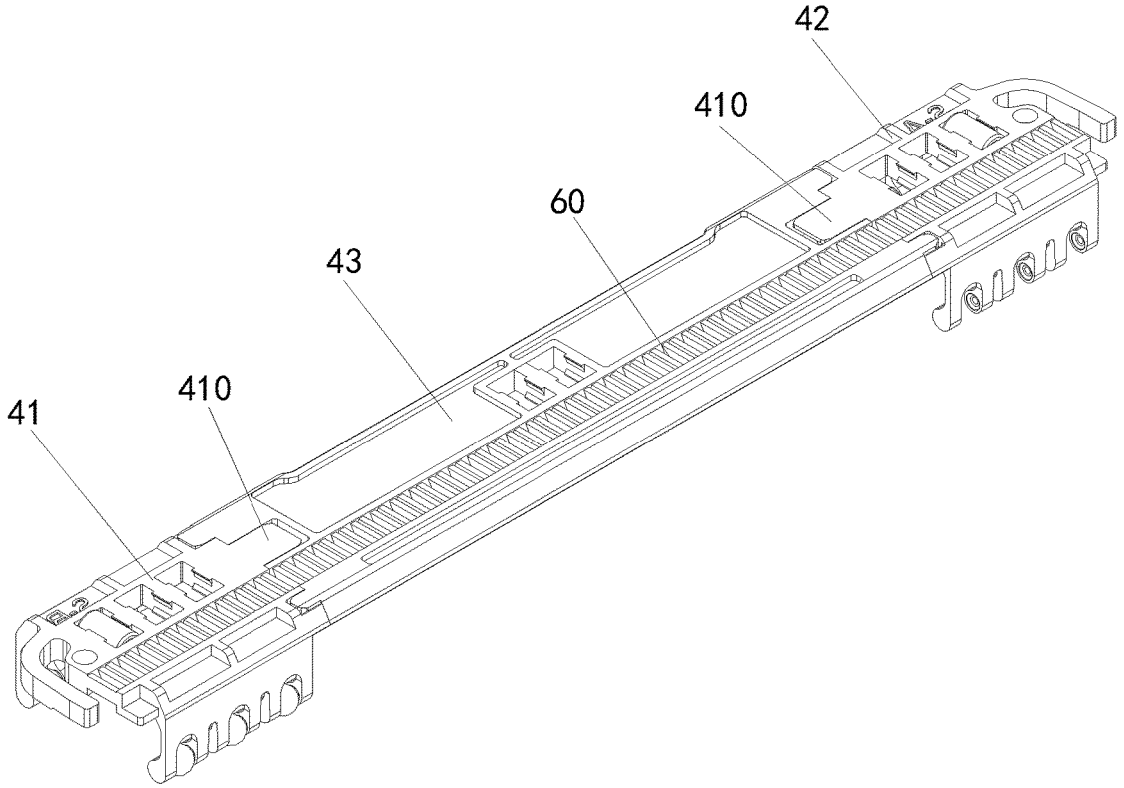
FIG. 13 is a schematic view showing a structure of the assembled upper linkage rack of the three-section linkage drawer slides apparatus according to an embodiment of the invention.
Figure 14:
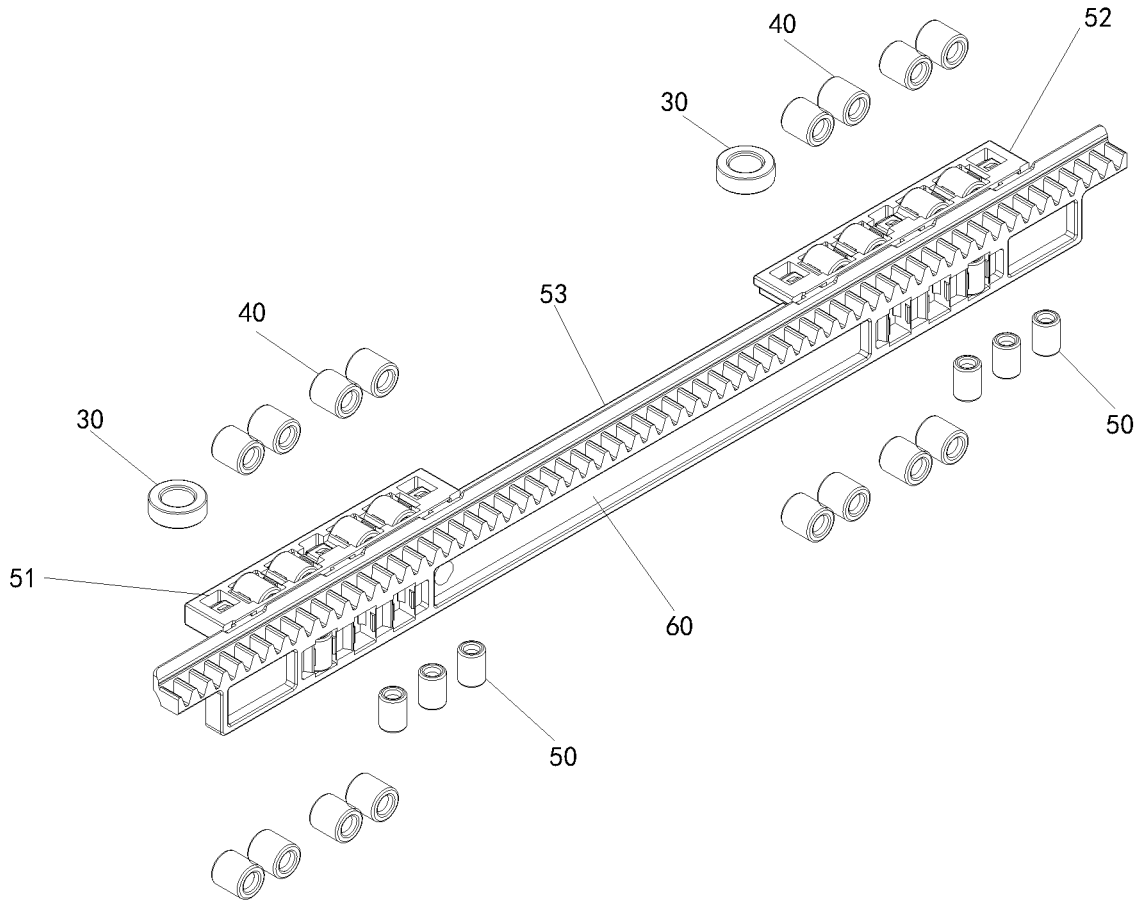
FIG. 14 is a schematic view showing a first explosion mode of the lower linkage rack of the three-section linkage drawer slides apparatus according to an embodiment of the invention.
Figure 15:
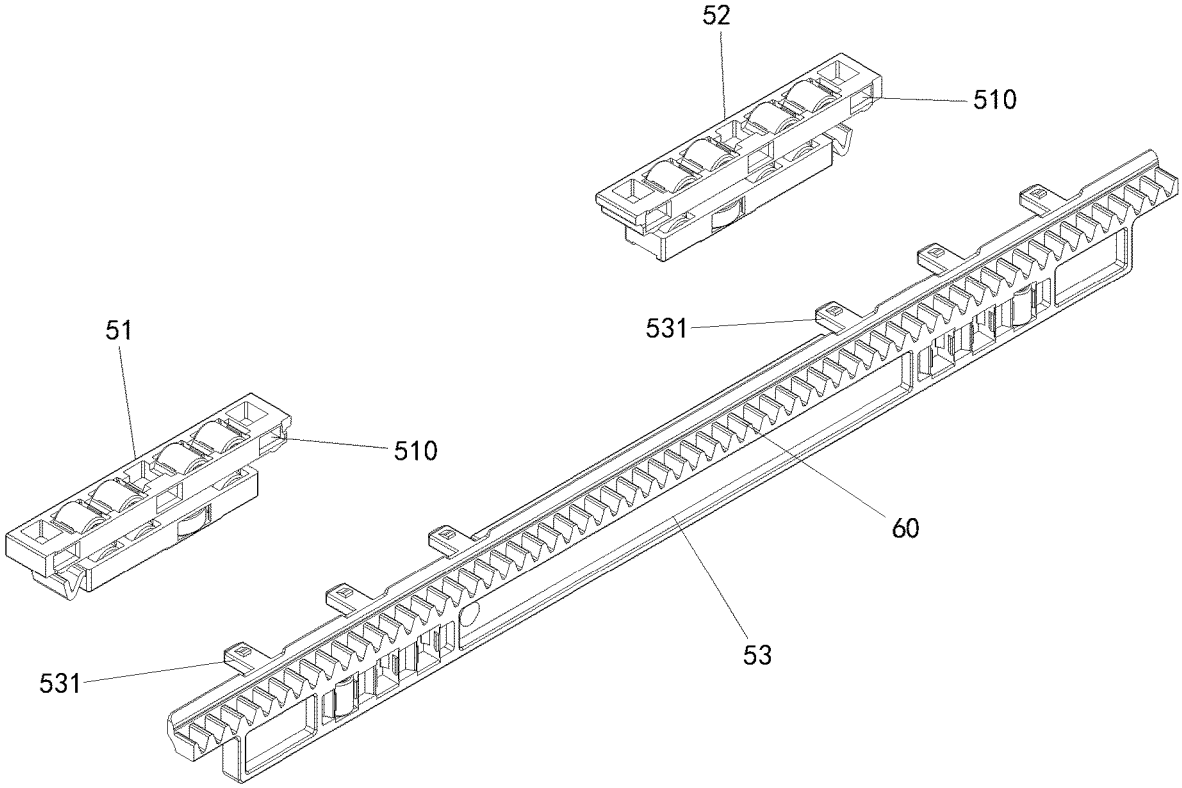
FIG. 15 is a schematic view showing a second explosion mode of the lower linkage rack of the three-section linkage drawer slides apparatus according to an embodiment of the invention.
Figure 16:
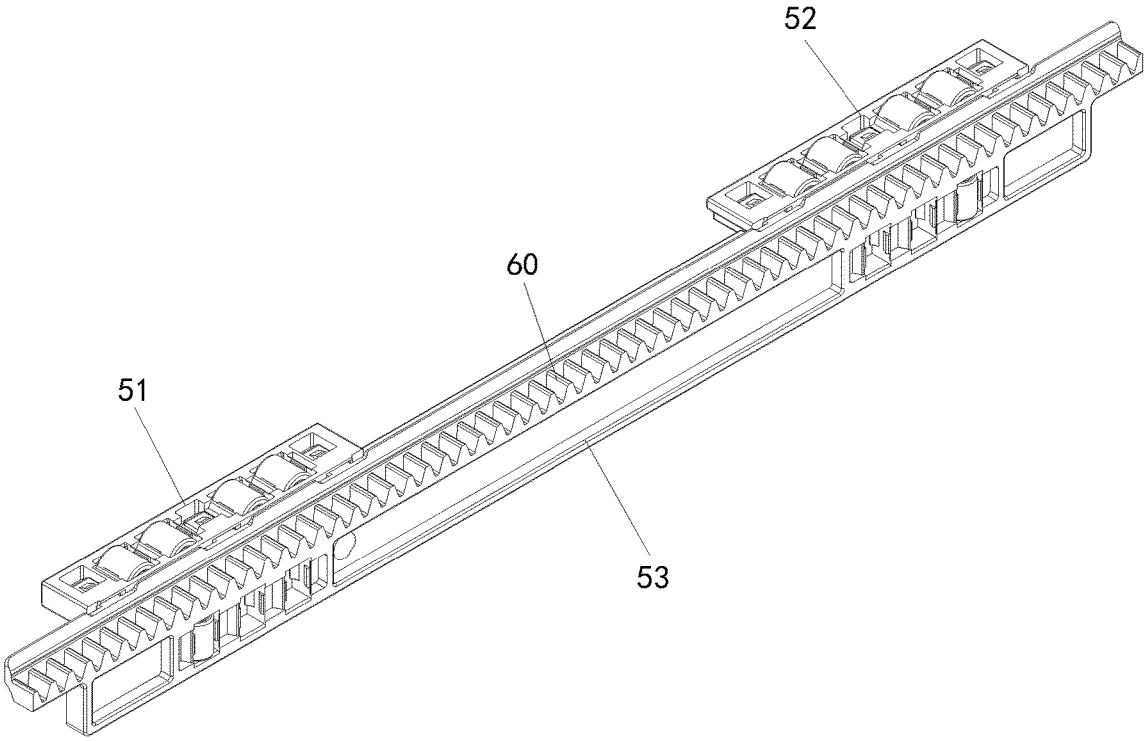
FIG. 16 is a schematic view showing a structure of the assembled lower linkage rack of the three-section linkage drawer slides apparatus according to an embodiment of the invention.
Figure 17:
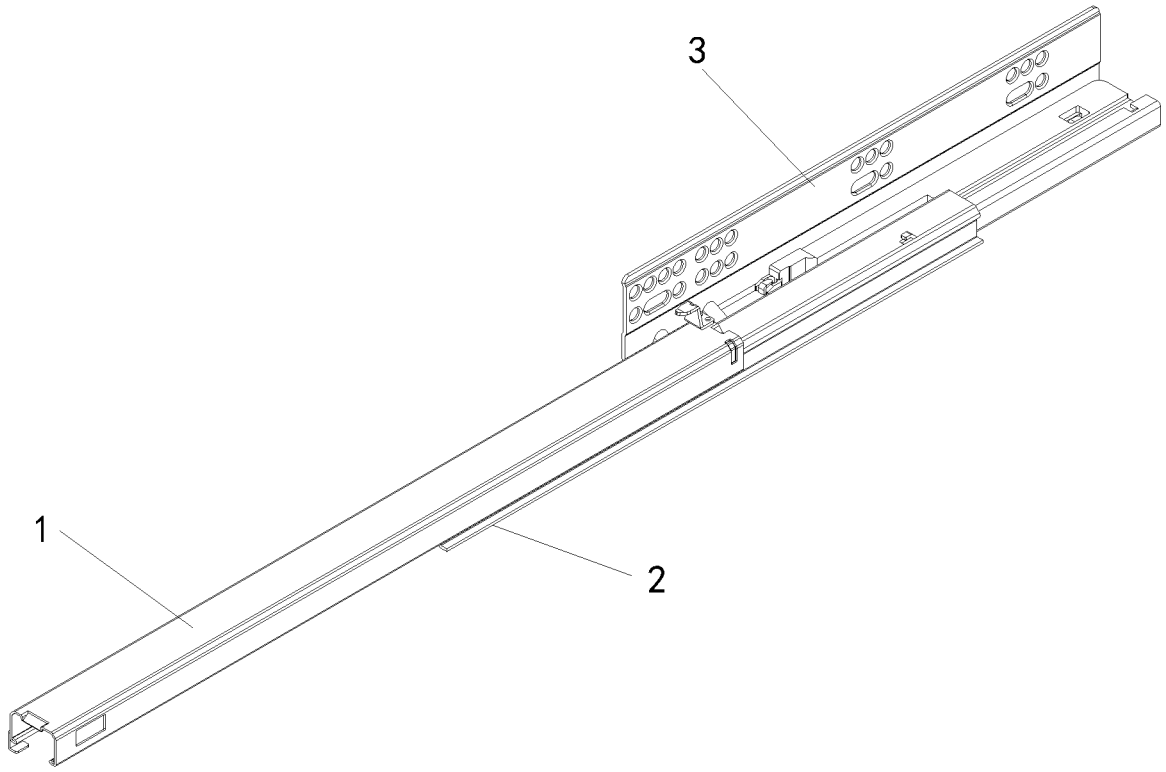
FIG. 17 is a schematic view showing a structure of an assembled three-section linkage drawer slides apparatus from a first angle according to an embodiment of the invention.
Figure 18:
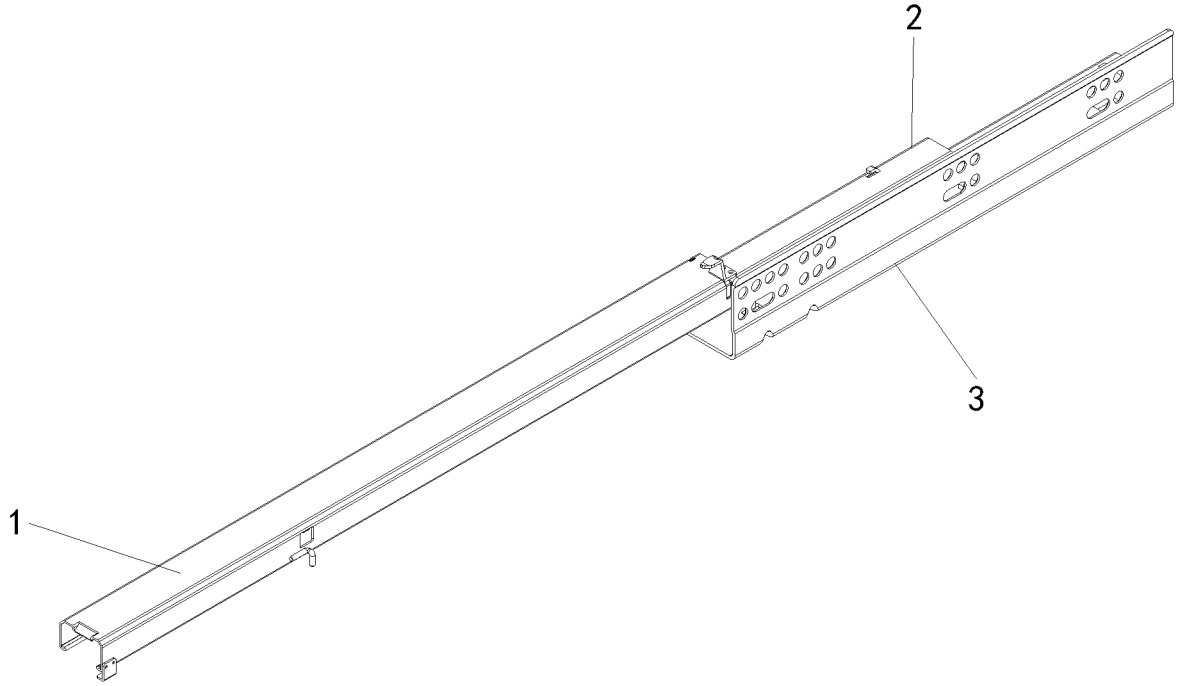
FIG. 18 is a schematic view showing a structure of the assembled three-section linkage drawer slides apparatus from a second angle according to an embodiment of the invention.
Figure 19:
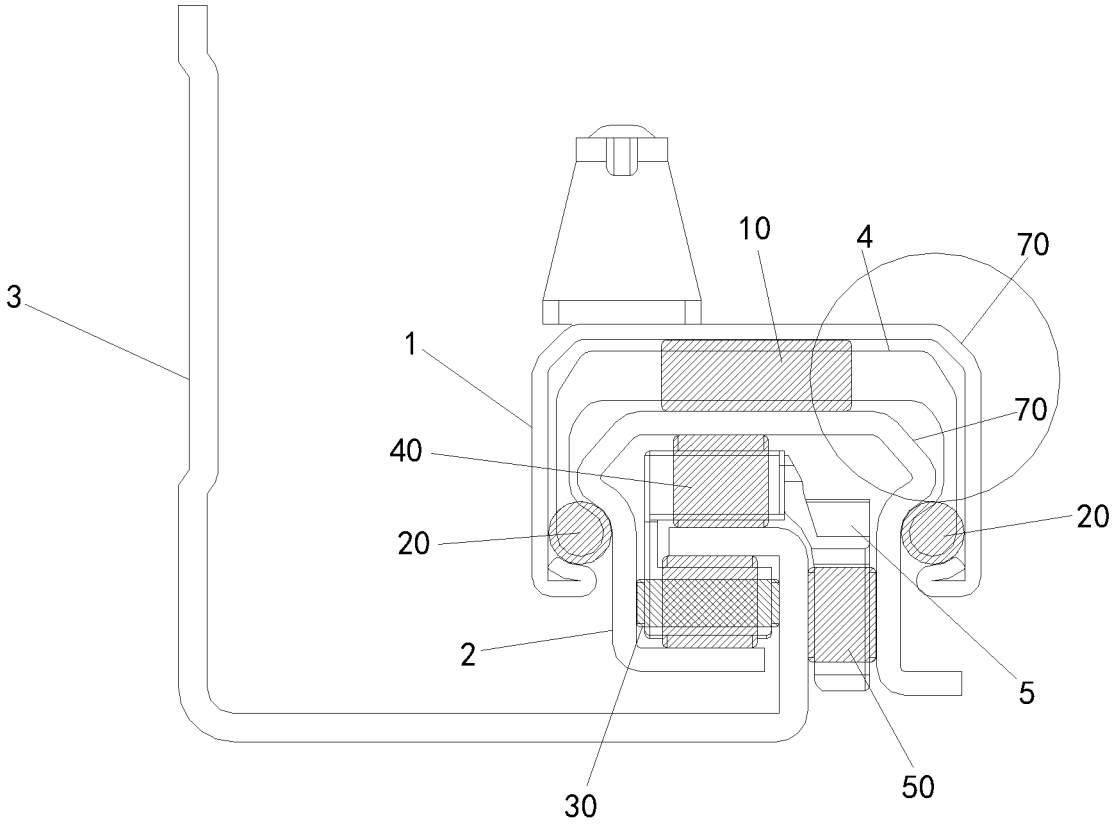
FIG. 19 is a cross-sectional schematic view showing a structure of the assembled three-section linkage drawer slides apparatus from the second angle according to an embodiment of the invention.
Figure 20:
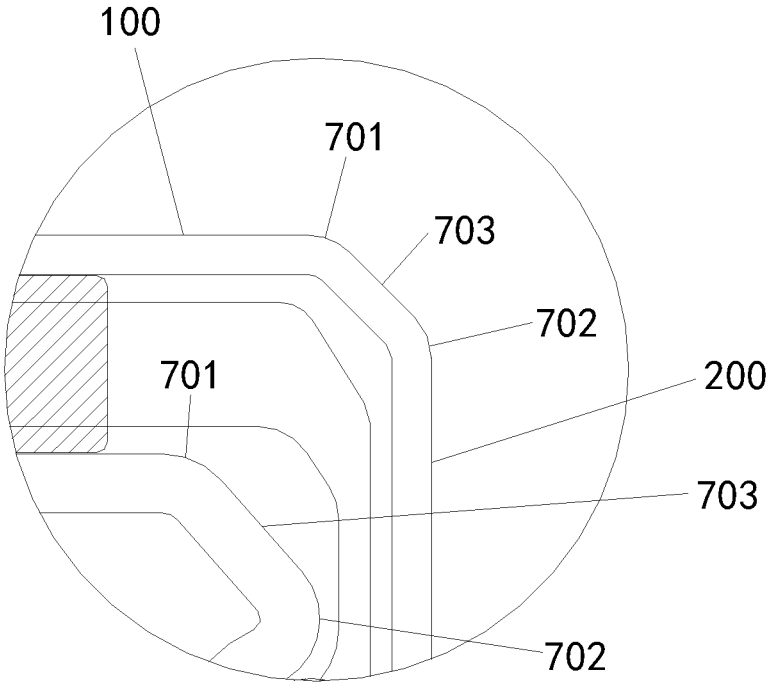
FIG. 20 is a partially enlarged diagram of the cross-sectional schematic view showing a structure of the assembled three-section linkage drawer slides apparatus from the second angle according to an embodiment of the invention.
Figure 21:
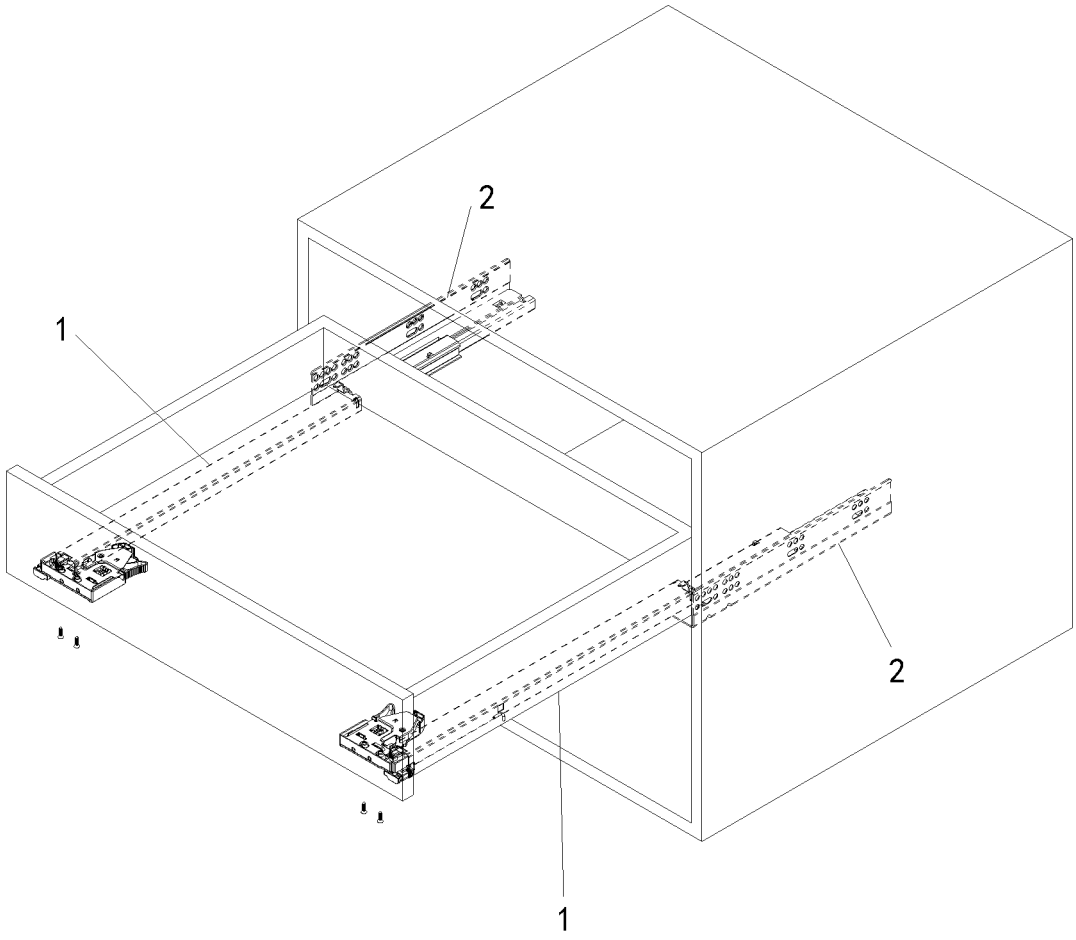
FIG. 21 is a schematic view of the three-section linkage drawer slides apparatus is provided on a drawer according to an embodiment of the invention.

With reference to FIGS. 1 to 21, the invention provides a three-section linkage drawer slides apparatus, including an upper rail 1, a middle rail 2, a fixed rail 3, an upper linkage rack 4 and a lower linkage rack 5, the middle rail 2 is slidably connected to the fixed rail 3 through the lower linkage rack 5, the upper rail 1 is slidably connected to the middle rail 2 through the upper linkage rack 4, the upper linkage rack 4 and the lower linkage rack 5 are of separate structures, the upper linkage rack 4 is mounted between the middle rail 2 and the upper rail 1 after being assembled, and the lower linkage rack 5 is mounted between the fixed rail 3 and the middle rail 2 after being assembled. According to the invention, wherein the upper linkage rack 4 and the lower linkage rack 5 are configured as separate structures, the manufacturing process can thus be simplified, so the manufacturing cost is reduced; the separate structures can be quickly assembled into an integrated structure and shared in drawer slides with different lengths, which reduces the production and assembly difficulty, facilitates assembling and disassembling the drawer slide device, renders good sliding performance, and greatly improves production efficiency.

In this embodiment, the upper linkage rack 4 includes a first upper wheel frame 41, a second upper wheel frame 42 and an upper linkage rack body 43, the first upper wheel frame 41 and the second upper wheel frame 42 are respectively detachably connected to the front and the rear ends of the upper linkage rack body 43, the first upper wheel frame 41 and the second upper wheel frame 42 are respectively provided with an upper wheel 10 at upper portions thereof, the first upper wheel frame 41 and the second upper wheel frame 42 are respectively provided with a ball wheel 20 on left and right side portions thereof, and the upper wheel 10 and the ball wheel 20 are positioned between the upper rail 1 and the middle rail 2. According to the invention, the upper linkage rack 4 includes the first upper wheel frame 41, the second upper wheel frame 42 and the upper linkage rack body 43, the manufacturing process can be simplified through the configuration of the separate structure of the upper linkage rack 4, so the manufacturing cost is reduced; the separate structures can be quickly assembled into an integrated structure and the first upper wheel frame 41 and the second upper wheel frame 42 can be shared in drawer slides with different lengths, which reduces the production and assembly difficulty, facilitates assembling and disassembling the drawer slide device, renders good sliding performance, and greatly improves production efficiency; the upper wheel 10 and the ball wheel 20 are arranged between the upper rail 1 and the middle rail 2 and can support, roll and orient the middle rail 2 and the upper rail 1 during operation of the drawer slides.

In this embodiment, the front and rear ends of the upper linkage rack body 43 are provided, respectively, with a clamping groove 431 and a limiting block 432 provided at an opening of the clamping groove 431, the first upper wheel frame 41 and the second upper wheel frame 42, at ends facing the upper linkage rack body 43, are respectively provided with a limiting protrusion 410 matched with the clamping groove 431, and when the first upper wheel frame 41 and the second upper wheel frame 42 are respectively connected to the front and rear ends of the upper linkage rack body 43, the limiting protrusions 410 of the first upper wheel frame 41 and the second upper wheel frame 42 slide into the clamping grooves 431 through the limiting blocks 432 at the two ends of the upper linkage rack body 43 respectively to be fixed. According to the invention, the arrangement of the clamping grooves 431, the limiting blocks 432 and the limiting protrusions 410 can facilitate mounting the first upper wheel frame 41, the second upper wheel frame 42 and the upper linkage rack body 43, the first upper wheel frame 41 and the second upper wheel frame 42 can thus be quickly assembled with the upper linkage rack body 43 into an integrated structure, and the first upper wheel frame 41 and the second upper wheel frame 42 can be shared in drawer slides with different lengths, which reduces the production and assembly difficulty, facilitates assembling and disassembling the drawer slide device, renders good sliding performance, and greatly improves production efficiency.

In this embodiment, the lower linkage rack 5 includes a first lower wheel frame 51, a second lower wheel frame 52 and a lower linkage rack body 53, the first lower wheel frame 51 and the second lower wheel frame 52 are respectively detachably connected with two ends of the left side portion of the lower linkage rack body 53, and a large wheel 30 is provided on the side portions, facing the lower linkage rack body 53, of the first lower wheel frame 51 and the second lower wheel frame 52; a middle wheel 40 is provided at both an upper portion and a bottom portion of the first lower wheel frame 51 and the second lower wheel frame 52, respectively; a small wheel 50 is provided at two ends, opposite the first lower wheel frame 51 and the second lower wheel frame 52, of the right side portion of the lower linkage rack body 53, respectively; and the large wheel 30, the middle wheel 40 and the small wheel 50 are arranged between the fixed rail 3 and the middle rail 2. According to the invention, the upper and lower linkage rack 5*s* include the first lower wheel frame 51, the second lower wheel frame 52 and the lower linkage rack body 53, the manufacturing process can be simplified through the configuration of the separate structure of the lower linkage rack 5, so the manufacturing cost is reduced; the separate structures can be quickly assembled into an integrated structure and the first lower wheel frame 51 and the second lower wheel frame 52 can be shared in drawer slides with different lengths, which reduces the production and assembly difficulty, facilitates assembling and disassembling the drawer slide device, renders good sliding performance, and greatly improves production efficiency; the large wheel 30, the middle wheel 40 and the small wheel 50 are positioned between the fixed rail 3 and the middle rail 2 and can support, roll and orient the middle rail 2 and the fixed rail 3 during operation of the drawer slides.

In this embodiment, both ends of the left side portion of the lower linkage rack body 53 are provided with fixing protrusions 531, the side portions, facing the upper linkage rack body 43, of the first lower wheel frame 51 and the second lower wheel frame 52 are provided with fixing grooves 510 matched with the fixing protrusions 531, and when the first lower wheel frame 51 and the second lower wheel frame 52 are respectively connected to both ends of the left side portion of the lower linkage rack body 53, the fixing protrusions 531 at the two ends of the left side portion of the lower linkage rack body 53 are respectively clamped into the fixing grooves 510 to render fixation. According to the invention, the arrangement of the fixing protrusions 531 and the fixing grooves 510 can facilitate mounting the first lower wheel frame 51, the second lower wheel frame 52 and the lower linkage rack body 53, so the first lower wheel frame 51 and the second lower wheel frame 52 can be quickly assembled with the lower linkage rack body 53 into an integrated structure, the first lower wheel frame 51 and the second lower wheel frame 52 can be shared in drawer slides with different lengths, which reduces the production and assembly difficulty, facilitates assembling and disassembling the drawer slide device, renders good sliding performance, and greatly improves production efficiency.

In this embodiment, the middle rail 2 is also provided with a gear assembly 6, the gear assembly 6 includes a mounting seat 61 and a gear 62, the middle rail 2 is provided with a fixing hole 21, the mounting seat 61 is fixed in the fixing hole 21, the gear 62 is disposed on the mounting seat 61, and the upper end and the lower end of the gear 62 are respectively connected with the upper linkage rack 4 and the lower linkage rack 5 after reaching out, a rack adapted to the gear 62 is provided on the upper linkage rack 4 and the lower linkage rack 5, respectively; and when the upper rail 1 slides on the middle rail 2, the gear 62 transmits between the rack of the upper linkage rack 4 and the rack of the lower linkage rack 5. According to the invention, the above arrangement can enable the gear 62 to be quickly clamped into the middle rail 2 after the gear 62 is mounted on the mounting seat 61; after the drawer slide device is assembled, the gear 62, the upper linkage rack 4 and the lower linkage rack 5 can interact and are connected together to realize mutual transmission, and when the drawer slide device performs a push-pull action, the upper linkage rack 4 and the lower linkage rack 5 can move relative to each other driven by the gear 62, thereby realizing the three-section linkage movement function of the drawer slide device.

In this embodiment, the first upper wheel frame 41, the second upper wheel frame 42 and the upper linkage rack body 43 are provided with racks 60 respectively along a length direction thereof, the racks 60 of the first upper wheel frame 41, the second upper wheel frame 42 and the upper linkage rack body 43 are in opposite positions along a straight line when connected, and are positioned on a side of the connection of the limiting protrusion 410 and the clamping groove 431; and the rack 60 of the lower linkage rack 5 is disposed on the lower linkage rack body 53 along a length direction thereof. According to the invention, the above arrangement can enable the first upper wheel frame 41 and the second upper wheel frame 42 to be assembled with linkage rack bodies with different lengths, the transmission of the gear 62 between the rack 60 of the upper linkage rack 4 and the rack 60 of the lower linkage rack 5 is not influenced after being assembled, which reduces difficulties in production and assembling, facilitates assembling and disassembling, and greatly improves the production efficiency.

In this embodiment, the mounting seat 61 includes a base 611, the base 611 is provided with a slot 6111 for mounting a gear 62, a limiting shaft 6112 is provided on an inner wall of the slot 6111, a shaft hole 621 matched with the limiting shaft 6112 is provided at a central position of the gear 62, and when the gear 62 is mounted in the slot 6111, the limiting shaft 6112 extends into the shaft hole 621, so that the gear 62 can rotate in the slot 6111 and thus transmission is realized between the rack of the upper linkage rack 4 and the rack of the lower linkage rack 5. According to the invention, the above arrangement can enable the gear assembly 6 to perform transmission better between the rack of the upper linkage rack 4 and the rack of the lower linkage rack 5, so that the upper linkage rack 4 and the lower linkage rack 5 can move relative to each other driven by the gear 62, thereby realizing the three-section linkage movement function of the drawer slide device.

In this embodiment, the two ends of the base 611 are integrally connected with elastic structures 612, respectively, the elastic structure 612 is of a U-shape and is provided with limiting steps 6121 at an end, the fixing hole 21 in the middle shaft includes a middle hole 211 matched with the base 611 and square holes 212 matched with the limiting steps 6121 of the elastic structure at the two ends of the base 611, and the base 611 is inserted into the middle hole 211 when the mounting seat 61 is mounted on the middle shaft, moreover, the limiting steps 6121 of elastic structures 612 at two ends of the base 611 are clamped into the square holes 212 to realize fixation. According to the invention, the arrangement of the middle hole 211 and the square hole 212 enables the base 611 to be mounted in the middle hole 211 of the middle rail 2, effectively fixing the horizontal front-rear and left-right positions of the gear 62; moreover, the limiting steps 6121 of the elastic structures 612 at the two ends of the base 611 are mounted in the square holes 212 of the middle rail 2, effectively fixing the vertical direction of the gear 62 by the arrangement of the limiting steps 6121, so that the positions of the gear assembly 6 and the middle rail 2 are fixed; the above design is structurally reasonable, the gear 62 and the base 611 can be quickly clamped into the middle rail 2 after being mounted, which is facilitated.

In this embodiment, the bent corners of two sides of the middle rail 2 and the upper rail 1 are reinforcing rib structures 70. According to the invention, the arrangement of the reinforcing rib structure 70 enables the middle rail 2 and the upper rail 1 to be better stressed, and the structure is more stable. The middle rail 2 and the upper rail 1 each includes an upper plate portion 100 and two side bent portions 200, the upper plate portion 100 and the two side bent portions 200 of the middle rail 2 and the upper rail 1 are connected through a reinforcing rib structure 70, the reinforcing rib structure 70 includes a first bending point 701, a second bending point 702 and an inclined plane 703, two ends of the inclined plane 703 are integrally connected with the first bending point 701 and the second bending point 702, respectively, and the first bending point 701 and the second bending point 702 are arc-shaped structures. According to the invention, the arrangement of the first bending point 701, the second bending point 702 and the inclined plane 703 enable the connections of the upper plate portion 100 with the two side bent portions 200 of the middle rail 2 or the upper rail 1 are bent twice, so that the reinforcing rib structure 70 is formed, thereby enhancing the bearing capacity and the stability, improving the stress condition of the middle rail 2 and the upper rail 1, and stabilizing the structure.

Compared with the prior art, the upper linkage rack and the lower linkage rack are configured as separate structures, the manufacturing process can thus be simplified, so the manufacturing cost is reduced; the separate structures can be quickly assembled into an integrated structure and shared in drawer slides with different lengths, which reduces the production and assembly difficulty, facilitates assembling and disassembling the drawer slide device, renders good sliding performance, and greatly improves production efficiency.

Preferred embodiments of the invention are shown above and are not intended to limit the invention. Any modification, equivalent replacement and improvement made within the spirit and principles of the invention should be included in the scope of the invention.

What is claimed is:

1. A three-section linkage drawer slides apparatus, comprising:

an upper rail;

a middle rail;

a fixed rail;

an upper linkage rack; and a lower linkage rack;

wherein the middle rail is slidably connected to the fixed rail through the lower linkage rack; the upper rail is slidably connected to the middle rail through the upper linkage rack; the upper linkage rack and the lower linkage rack are of separate structures; the upper linkage rack is mounted between the middle rail and the upper rail after being assembled; and the lower linkage rack is mounted between the fixed rail and the middle rail after being assembled;

wherein the upper linkage rack comprises a first upper wheel frame, a second upper wheel frame, and an upper linkage rack body; the first upper wheel frame and the second upper wheel frame are respectively detachably connected to front and rear ends of the upper linkage rack body; the first upper wheel frame and the second upper wheel frame are respectively provided with an upper wheel at upper portions thereof; the first upper wheel frame and the second upper wheel frame are respectively provided with a ball wheel on left and right side portions thereof; and the upper wheel and the ball wheel are positioned between the upper rail and the middle rail;

wherein the front and rear ends of the upper linkage rack body are provided, respectively, with a clamping groove and a limiting block provided at an opening of the clamping groove; the first upper wheel frame and the second upper wheel frame, at ends facing the upper linkage rack body, are respectively provided with a limiting protrusion matched with the clamping groove; and when the first upper wheel frame and the second upper wheel frame are respectively connected to the front and rear ends of the upper linkage rack body, the limiting protrusions of the first upper wheel frame and the second upper wheel frame slide into the clamping grooves through the limiting blocks at two ends of the upper linkage rack body respectively to be fixed; and wherein the lower linkage rack comprises a first lower wheel frame, a second lower wheel frame, and a lower linkage rack body; the first lower wheel frame and the second lower wheel frame are respectively detachably connected with two ends of a left side portion of the lower linkage rack body; and a large wheel is provided on side portions, facing the lower linkage rack body, of the first lower wheel frame and the second lower wheel frame; a middle wheel is provided at both an upper portion and a bottom portion of the first lower wheel frame and the second lower wheel frame, respectively; a small wheel is provided at two ends, opposite the first lower wheel frame and the second lower wheel frame, of a right side portion of the lower linkage rack body, respectively; and the large wheel, the middle wheel and the small wheel are arranged between the fixed rail and the middle rail.

2. The three-section linkage drawer slides apparatus of claim 1, wherein said two ends of the left side portion of the lower linkage rack body are provided with fixing protrusions, side portions, facing the upper linkage rack body, of the first lower wheel frame and the second lower wheel frame are provided with fixing grooves matched with the fixing protrusions, and when the first lower wheel frame and the second lower wheel frame are respectively connected to said two ends of the left side portion of the lower linkage rack body, the fixing protrusions at said two ends of the left side portion of the lower linkage rack body are respectively clamped into the fixing grooves to render fixation.

3. The three-section linkage drawer slides apparatus of claim 2, wherein the middle rail is also provided with a gear assembly, the gear assembly comprises a mounting seat and a gear, the middle rail is provided with a fixing hole, the mounting seat is fixed in the fixing hole, the gear is disposed on the mounting seat, and an upper end and a lower end of the gear are respectively connected with the upper linkage rack and the lower linkage rack after reaching out, a rack adapted to the gear is provided on the upper linkage rack and the lower linkage rack, respectively; and when the upper rail slides on the middle rail, the gear transmits between the rack of the upper linkage rack and the rack of the lower linkage rack.

4. The three-section linkage drawer slides apparatus of claim 3, wherein the first upper wheel frame, the second upper wheel frame and the upper linkage rack body are provided with racks respectively along a length direction thereof, the racks of the first upper wheel frame, the second upper wheel frame and the upper linkage rack body are in opposite positions along a straight line when connected, and are positioned on a side of a connection of the limiting protrusion and the clamping groove; and the rack of the lower linkage rack is disposed on the lower linkage rack body along a length direction thereof.

5. The three-section linkage drawer slides apparatus of claim 3, wherein the mounting seat comprises a base, the base is provided with a slot for mounting a gear, a limiting shaft is provided on an inner wall of the slot, a shaft hole matched with the limiting shaft is provided at a central position of the gear, and when the gear is mounted in the slot, the limiting shaft extends into the shaft hole, so that the gear can rotate in the slot and thus transmission is realized between the rack of the upper linkage rack and the rack of the lower linkage rack.

6. The three-section linkage drawer slides apparatus of claim 5, wherein two ends of the base are integrally connected with elastic structures, respectively, each said elastic structure is of a U-shape and is provided with limiting steps at an end, the fixing hole in the middle rail comprises a middle hole matched with the base and square holes matched with the limiting steps of the elastic structures at said two ends of the base, and the base is inserted into the middle hole when the mounting seat is mounted on the middle rail, moreover, the limiting steps of elastic structures at said two ends of the base are clamped into the square holes to realize fixation.

* * * * *